US006605902B2

(12) United States Patent
Shimoda et al.

(10) Patent No.: US 6,605,902 B2
(45) Date of Patent: Aug. 12, 2003

(54) DISPLAY AND ELECTRONIC DEVICE

(75) Inventors: Tatsuya Shimoda, Suwa (JP); Satoru Miyashita, Suwa (JP); Satoshi Inoue, Suwa (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 09/900,521

(22) Filed: Jul. 6, 2001

(65) Prior Publication Data

US 2002/0149037 A1 Oct. 17, 2002

(30) Foreign Application Priority Data

Jul. 7, 2000 (JP) ..... P2000-207392

(51) Int. Cl.[7] ..... G09G 3/10

(52) U.S. Cl. ..... 315/169.1; 315/169.3; 345/76; 345/214

(58) Field of Search ..... 315/169.1, 169.3; 345/76, 84, 55, 211, 214

(56) References Cited

U.S. PATENT DOCUMENTS 5,367,393 A * 11/1994 Ohara et al. ..... 359/67
5,545,291 A 8/1996 Smith et al. ..... 156/655.1
5,783,856 A 7/1998 Smith et al. ..... 156/655.1
5,824,186 A 10/1998 Smith et al. ..... 257/618
5,904,545 A 5/1999 Smith et al. ..... 438/455
6,072,450 A * 6/2000 Yamada et al. ..... 345/76
6,097,351 A * 8/2000 Nishida ..... 345/1
6,104,459 A * 8/2000 Oike et al. ..... 349/105
6,236,388 B1 * 5/2001 Iida et al. ..... 345/132

* cited by examiner

*Primary Examiner*—Don Wong
*Assistant Examiner*—Thuy Vinh Tran
(74) *Attorney, Agent, or Firm*—Harness, Dickey & Pierce, P.L.C.

(57) ABSTRACT

A display is provided which is constructed with a plurality of display blocks linked together so as to be continuous in the vertical direction. Each display block comprises a display portion having a flat rectangular shape with a plurality of pixels which emit light using organic EL elements, arranged over the entire face in a matrix, and a terminal portion provided continuous with one of the short sides of the display portion for relaying signals or power from the outside to each pixel. Each display block is attached on a transparent substrate via a transparent adhesive so that the long sides of the display portion are contacted and are vertically continuous. The display surface of the display portion (the surface on the side which the emitted light in the organic EL element illuminates) faces towards the transparent substrate side. As a result, the light from the display portion shines from the surface of the transparent substrate to the outside.

14 Claims, 8 Drawing Sheets

DISPLAY AND ELECTRONIC DEVICE

BACKGROUND OF THE INVENTION

1. Field of the Invention

The present invention relates to a display which can be used in a computer display unit or television receiver or the like, and to electronic devices suitable for such a display. In particular the invention is one which enables a display device which is precise yet large size to be easily realized.

2. Description of Related Art

Heretofore, CRT or liquid crystal displays or the like are used for example in computer display units. Furthermore, there are many situations where displays which use light emitting diodes are applied to large size display units provided for example on the walls of buildings.

Moreover, there is also the situation where for a display unit set up outdoors, an overall large size display unit is realized by horizontally and vertically stacking a plurality of CRT receiving sets.

In the conventional construction of a CRT display or liquid crystal display or the like, in the case where a large size display unit is to be realized, generally the dimensions of the display screen itself are made large size, that is, the dimensions of one display are made to a desired size. However with such a method, the dimensions of each part of the manufacturing line must also be made large corresponding to the desired dimension of the display. Furthermore, the handling of the semi-finished products during manufacture is difficult. Hence there is naturally a limit to the size which can be manufactured.

On the other hand, with a large size display which uses light emitting diodes, the construction is such that individually manufactured light emitting diodes are assembled together to make up the display. Therefore, even though a large size display is manufactured, the dimensions of each part of the manufacturing line need not be large for this. Hence this is advantageous as a method of manufacturing large size displays. However, with actual large size displays which use light emitting diodes, it is assumed that these will be viewed from a distance. Therefore, the diameter of the individual light emitting diodes is made large and the pixel pitch is coarse. Consequently, for close up viewing use as with large size household displays, the pixels are too coarse and hence this is unsuitable.

Furthermore, with a construction where a plurality of CRT receiving sets are stacked together to give a large size display unit, image precision is obtained. However this has the drawback in that since the frame part of the CRT receiving set exists between the respective CRT receiving set pairs, the image is divided at that part.

BRIEF SUMMARY OF THE INVENTION

The present invention addresses such unsolved problems of the conventional technology, with the object of providing a construction for a display where the image is precise, and which is also applicable to large size, and to provide a construction for electronic devices suitable for such a display.

In order to achieve the above object, a display, being a first aspect of the present invention, is one in which a plurality of display blocks comprising a plurality of pixels, and a terminal portion into which signals can be input for controlling optical characteristics of each of the pixels, are linked together so as to be continuous in at least one of a horizontal direction and a vertical direction, and signals are input in parallel to each of the display blocks via the terminal portion. Here "optical characteristics" indicates for example transmissivity or the like of a liquid crystal in a liquid crystal display device.

Furthermore, a display, being a second aspect of the present invention, is one in which a plurality of display blocks comprising a plurality of pixels, and a terminal portion into which signals can be input for controlling light emitting characteristics of each of the pixels, are linked together so as to be continuous in at least one of a horizontal direction and a vertical direction, and signals are input in parallel to each of the display blocks via the terminal portion.

In order to achieve the above object, a display, being a third aspect of the present invention, is one in which a plurality of display blocks comprising a plurality of pixels containing organic EL elements, and a terminal portion into which signals can be input for controlling light emitting characteristics of each of the pixels, are attached to a transparent substrate so that a display surface faces the transparent substrate side and so that the display blocks are continuous in at least one of a horizontal direction and a vertical direction, and signals are input in parallel to each of the display blocks via the terminal portion.

Moreover, a fourth aspect of the present invention is that in the display being the second or third aspect, a power supply being supplied in parallel to each of the display blocks via the terminal portion.

Furthermore, a fifth aspect of the present invention is that in any one of the second through fourth aspects, a terminal portion which respectively conducts horizontally extending wiring and vertically extending wiring inside the display block being gathered at one side of each display block, so that the terminal portion is only provided at one side of the display block.

A sixth aspect of the present invention is that in the display, being the second through fifth aspects, the terminal portion being provided so as to be positioned on a rear side rather than a periphery portion of the display block.

Moreover, a seventh aspect of the present invention is that in the display, being the second through sixth aspects, the display blocks having a construction in which a plurality of microstructures made with electronic circuit elements are disposed on a substrate.

Furthermore, an eight aspect of the present invention is that in the display, being the seventh aspect, a drive circuit for the pixel being made in the microstructure.

On the other hand, in order to achieve the above object, a ninth aspect of the present invention is that in an electronic device comprising horizontally extending wiring and vertically extending wiring, there being provided a plurality of microstructures arranged on a substrate at positions corresponding to those where the horizontally extending wiring and vertically extending wiring intersect, and in the microstructures there being provided a portion of the horizontally extending wiring and the vertically extending wiring which includes a portion where the two wiring non-contactingly intersect with each other, a first direction conversion wiring which conducts with one of the horizontally extending wiring and the vertically extending wiring and which is taken out from the microstructure in the same direction as the other of the two, a second direction conversion wiring which does not conduct with the other wiring inside the microstructure, and which is taken out from the microstructure in the same direction as the first direction conversion wiring and so as to be adjacent thereto, and pairs of the horizontally extending wiring of the microstructure which are adjacent in the horizontal direction being connected, and pairs of the vertically extending wiring of the microstructure which are adjacent in the vertical direction being connected, and furthermore the first direction conversion wiring and the second direction conversion wiring of adjacent microstructures being selectively connected, so that end portions conducting with the horizontally extending wiring and the vertically extending wiring are gathered at one side of the substrate.

In order to achieve the above object, a tenth aspect of the present invention is that in the electronic device, being the ninth aspect, plurality of microstructures with drive circuits being arranged on a substrate, and the microstructures being connected by wiring, and a signal can be supplied from the outside to a terminal portion of the wiring.

Here in the first or second aspects of the present invention, since the display is constructed with a plurality of display blocks linked together, a display of optional dimensions can be easily realized, and since each of the display blocks are linked together so as to be continuous, there is no situation where the image is discontinuous between the display blocks. Furthermore, in each of the display blocks, signals are input in parallel to each display block via the terminal portion. Therefore, then even if the number of pixels of the display is large, there is no situation where scanning is not on time.

Furthermore, in the third aspect of the present invention, each pixel comprises an organic EL (electroluminescence) element and each display block is attached to the transparent substrate so that the display surface (typically the surface on the other side to the cathode of the organic EL element) through which the emitted light from the organic EL elements shines to the outside faces the transparent substrate side. Therefore the emitted light from each display block is shone to the outside through the transparent substrate. Moreover, by attaching each display block to the transparent substrate so that these become mutually continuous, the situation where an image which can be seen from the rear face side (the side opposite to the display block attachment side) of the transparent substrate becomes discontinuous between each display block does not arise. Hence a display of optional dimensions can be easily realized. Furthermore as with the first aspect, since signals are input in parallel to each display block via the terminal portion, the situation where scanning is not on time does not arise even if the area of the display is large.

Moreover, in the fourth aspect of the present invention, power is supplied in parallel to each display block. Therefore, different to a construction where power is supplied altogether to the entire display, even if the area of the display becomes large, a situation where power supply for a part of the pixels is insufficient does not arise.

Furthermore, in the fifth aspect of the present invention, the terminal portion is provided on only one side of the display block. Therefore, this is convenient from the viewpoint that the display block pairs are continuous without gaps. That is, in a normal display, the end portions of the horizontally extending wiring, and the end portions of the vertically extending wiring are positioned separated on two adjacent sides. Therefore, if a display of the same shape is made continuous, there is the possibility that the ends of the wiring will cause an obstacle. On the other hand, in the fifth aspect, it is not necessary to take out the end portions of the wiring from the edge portions of three sides of the display block. Therefore it is relatively simple to link the display blocks so as to be continuous in one direction.

Furthermore, according to the sixth aspect of the present invention, the terminal portion is positioned on the rear face side (the face opposite to the display surface) of the display block, in other words the terminal portion is offset to the rear side of the display block. Therefore, the entire outer edge area of the portion where the pixels of the display block are disposed is exposed, so that the display block pairs can be made continuous with the edge portions of the adjacent display blocks in close contact.

In the sixth embodiment, if the construction is such that the pixel drive circuits are also contained in the terminal portion, arrangement of the pixels over the entire display surface of the display block is facilitated. Moreover, this avoids the situation where in the case where each display block pair is continuous, the spacing of the pixels at the boundaries is considerably wider than for the other portions.

On the other hand, regarding the seventh aspect of the present invention, the display blocks are constructed using microstructures. Therefore, even in cases where the proportion occupied by the electronic circuits with respect to the area of the display blocks is small, the situation where a large waste occurs for example in a semiconductor material is avoided.

The electronic circuits elements made in the microstructure, may be any elements, provided these are for constructing electronic circuits, for example transistors, capacitors, resistors, wiring and the like. In particular, in the case of displays where pixel drive circuits are necessary, the pixel drive circuits with combinations of such electronic circuit elements may be made in the microstructure.

Details of microstructures are given in detail in U.S. Pat. Nos. 5,904,545, 5,824,186, 5,783,856 and 5,545,291.

In the eighth aspect of the present invention, the pixel drive circuits are made in the microstructures. Therefore wiring drive circuits need not be separately provided at the peripheral portion of the display.

Moreover, in the ninth aspect of the present invention, the first direction conversion wiring and the second direction conversion wiring are provided inside the microstructure, and in adjacent microstructure pairs, the first direction conversion wiring and the second direction conversion wiring is selectively connected, and the end portion conducting the horizontally extending wiring and the vertically extending wiring can be gathered on one side of the substrate.

That is, according to the ninth aspect of the present invention, the portion where the horizontally extending wiring and the vertically extending wiring non-contactingly intersect is made in the microstructure, and the first direction conversion wiring and the second direction conversion wiring are also made in the microstructure, and are taken out from the microstructure with the first direction conversion wiring and the second direction conversion wiring in an adjacent condition. Therefore it is not necessary to non-contactingly intersect the wiring pairs on the substrate. More specifically, the wiring on the substrate need not be multi-layered wiring.

Regarding the electronic devices to which the ninth aspect can be applied, it is sufficient that these are electronic devices comprising horizontally extending wiring and vertically extending wiring, and for example there can be considered various devices which are provided with a display (organic EL display, liquid crystal display or the like) such as in the first through eighth aspects, sensor arrays, touch pads, fingerprint recognition apparatus, digital cameras and so on.

Moreover, in the tenth aspect of the present invention, the drive circuits are made in the microstructures. Therefore there is no longer the need to separately provide drive circuits at the peripheral portion of the electronic device.

Furthermore, as an electronic device to which the tenth aspect can be applied, for example there can be considered various devices which are provided with a display (organic EL display, liquid crystal display or the like) such as in the first through eighth aspects, sensor arrays, touch pads, fingerprint recognition apparatus, digital cameras and so on.

EFFECT OF THE INVENTION

According to the first through eighth aspects of the present invention, a display is realized by continuously arranging display blocks in at least one of a horizontal direction and a vertical direction. Therefore there is the effect that a precise and also large size display can be easily realized.

Furthermore, according to the ninth aspect of the present invention, the first direction conversion wiring and the second direction conversion wiring is provided in the microstructure, and these are selectively connected. Therefore there is the effect that the horizontally extending wiring and the vertically extending wiring can be easily gathered at one side.

Moreover, according to the tenth aspect of the present invention, the drive circuits are made in the microstructure. Therefore there is the effect that the drive circuits need not be separately provided at the periphery of the substrate.

DETAILED DESCRIPTION OF THE INVENTION

Hereunder is a description of embodiments of the present invention based on the drawings.

Figure 1A:
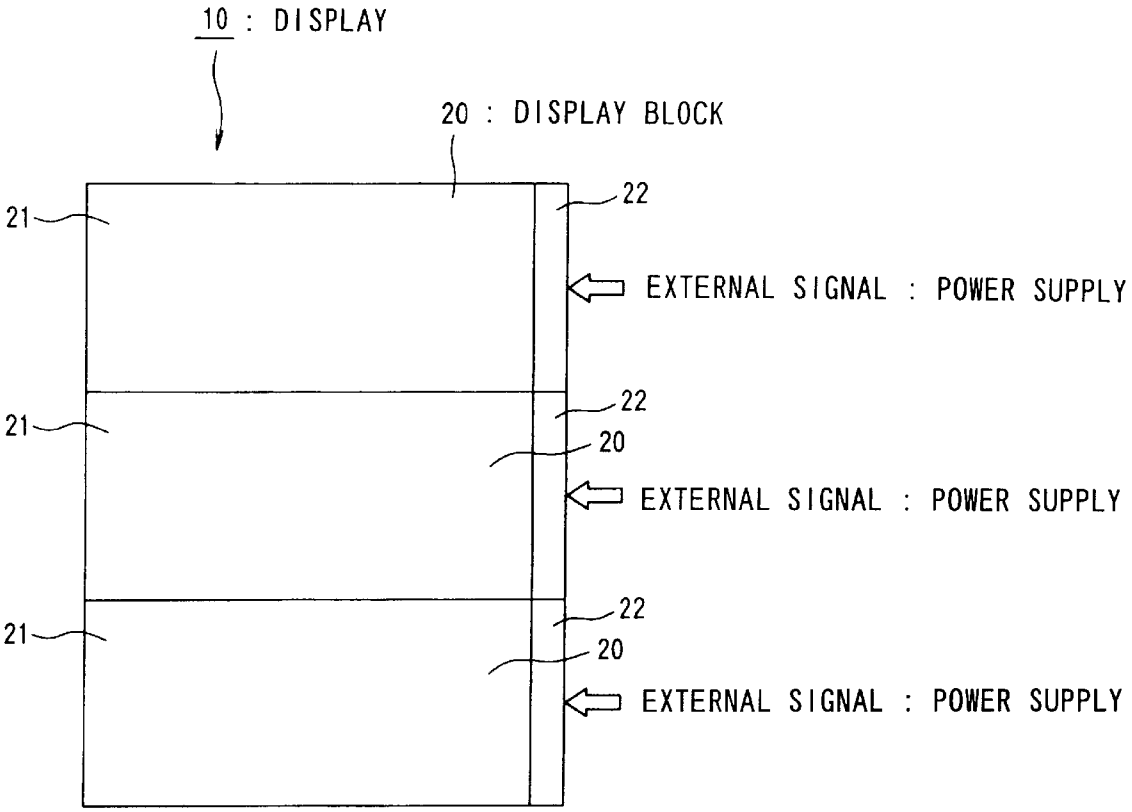
FIG. 1A and FIG. 1B are diagrams showing the construction of a first embodiment of the present invention.
Figure 1B:
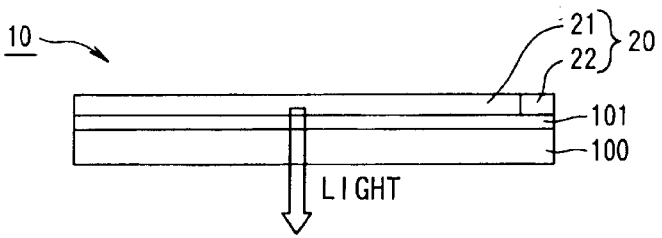

FIG. 1A, FIG. 1B, FIG. 2 and FIG. 3 are diagrams illustrating an embodiment of the present invention, FIG. 1A and FIG. 1B showing the overall construction of a display 1 according to the present invention, FIG. 1A being a rear elevation of a display 10 and FIG. 1B being a bottom view of the display 10.

That is, the display 10 of this embodiment is constructed with a plurality (three in this example) of display blocks 20 linked together so as to be continuous in the vertical direction.

Each display block 20 comprises a display portion 21 of flat rectangular shape with a plurality of pixels which emit light using organic EL elements, arranged over the entire face in matrix form, and a terminal portion 22 provided continuous with one of the short sides of the display panel 21 for relaying signals or power supply from the outside to each pixel. For the external signal, this may be an electrical signal or may be an optical signal. However in the case of the later, it is necessary to incorporate a photoelectric transducer in the terminal portion 22.

Furthermore, each display block 20 is attached on a synthetic resin or glass transparent substrate 100 via a transparent adhesive 101 so that long side pairs of the display panel 21 are contacted and are continuous vertically. A proviso is that the display surface of the display portion 21 (the surface on the side which the emitted light in the organic EL element illuminates) faces towards the transparent substrate 100 side. As a result, as shown in FIG. 1B, the light from the display panel 21 is shone from the surface of the transparent substrate 100 to the outside.

Figure 2:
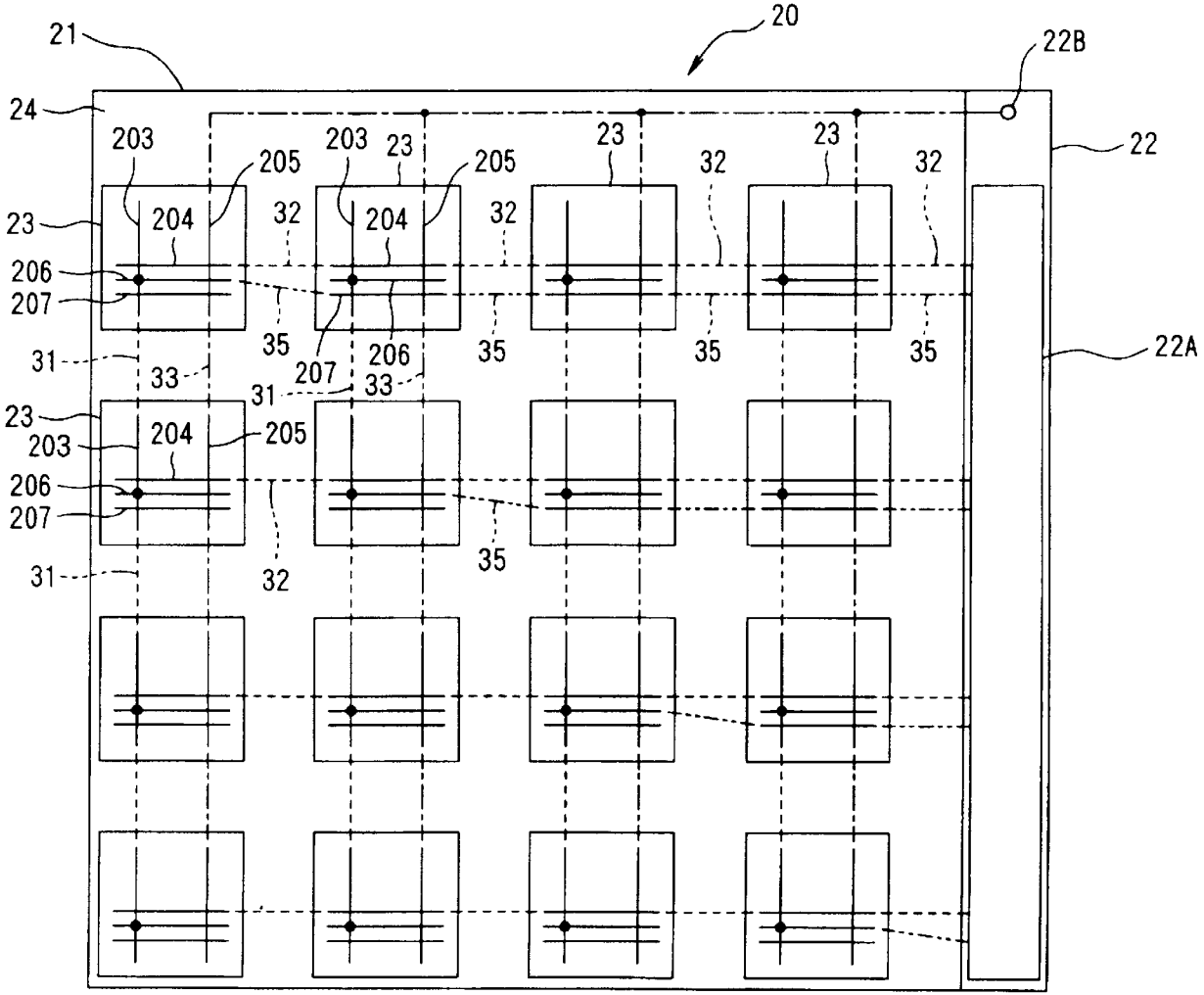
FIG. 2 is a schematic structural diagram illustrating a basic construction of a display block.

Here, the construction of the display blocks 20 will be described in detail following FIG. 2 and FIG. 3. FIG. 2 is a schematic plan view illustrating a basic construction of the display block 20. Actually, the display block 20 comprises a large number of pixels respectively arranged vertically and horizontally. However for convenience of illustration and explanation, the display block 20 shown in FIG. 2 has a pixel number of 16 (=4×4).

The display portion 21 of the display block 20 of this embodiment has microstructures 23 made with elements of electronic circuits arranged corresponding to each pixel position. The microstructures 23 are made by dividing up a structure made by a known photolithography process on a semiconductor wafer. This is detailed in the abovementioned U.S. Pat. Nos. 5,904,545, 5,824,186, 5,783,856 and 5,545,291.

The display panel 21 is then formed by inlaying the microstructures 23 in concavities (not shown in the figure) formed in a substrate 24 of the display block 20, forming a later described wiring on the substrate 24, and forming luminous portions of organic EL elements.

Figure 3:
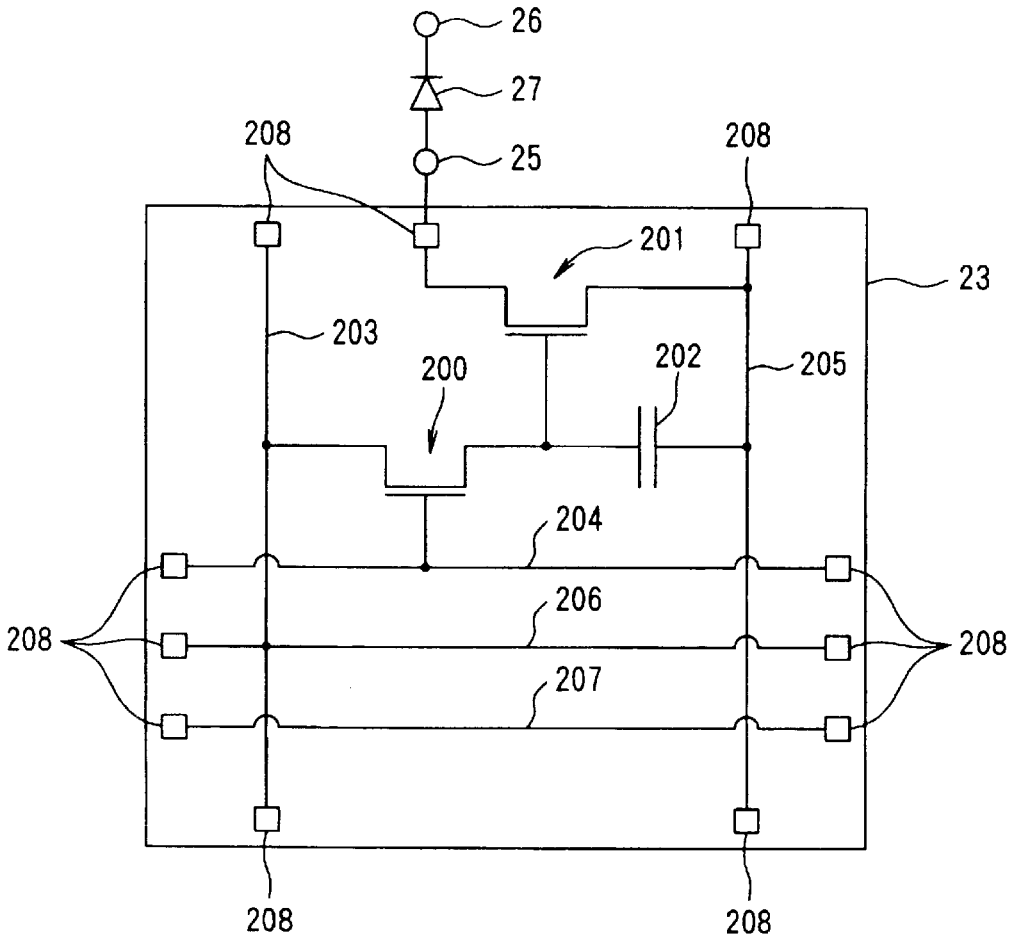
FIG. 3 is an equivalent circuit diagram illustrating the construction of a micro block.

The electronic circuits formed inside each of the microstructures 23, as shown in FIG. 3 comprise a switching transistor 200 a current control transistor 201 and a holding capacitor 202. The switching transistor 200 is a transistor for interrupting between a vertically extending signal line 203 and the holding capacitor 202, and a gate thereof is connected to a horizontally extending scanning line 204. The signal line 203 and the scanning line 204 must be mutually non-contacted. Therefore inside the microstructures 23 is a multi-layer wiring construction, the portion where the signal line 203 and the scanning line 204 mutually non-contactingly intersect being realized by using the multi-layer wiring. The construction of the portions for where intersection is necessary in the later described configuration for where respective wiring pairs do not conduct, is also similarly realized using multi-layer wiring.

The current control transistor 201 is a transistor for controlling the connection condition between a common electric supply line 205 and a pixel electrode 25 formed on the substrate 24, and a gate thereof is supplied with a potential held in the holding capacitor 202. The opposite side of the holding capacitor 202 is connected to the common electric supply line 205. Furthermore, an organic EL element 27 is formed as a pixel between a pixel electrode 25 and a similar opposing electrode 26 formed on the substrate 24.

Moreover, inside each of the microstructures 23, a first direction conversion wiring 206 and the second direction conversion wiring 207 are provided in adjacent positional relationship so as to run parallel with the scanning line 204. A proviso is that the first direction conversion wiring 206 is only conducting with the signal line 203 and is non-conducting with the other wiring. Furthermore, the second direction conversion wiring 207 does not conduct with any of the wiring.

The opposite ends of the signal line 203, the scanning line 204, the common electric supply line 205, the first direction conversion wiring 206 and the second direction conversion wiring 207, and the source and drain portions of the current control transistor 201 on the other side to the common electric supply line 205, are connected to pad portions 208 formed on peripheral edge portions or the like of the microstructure 23.

Returning to FIG. 2, each of the pad portion 208 pairs (in FIG. 2 illustration of the pad portions 208 is omitted) of each of the microstructures 23 conduct in predetermined combinations via wiring (shown by dashed lines, one dot chain lines, and two dot chain lines) formed on the substrate 24.

More specifically, the microstructure 23 pairs arranged in the vertical direction are connected with each other via vertically extending wiring 31 on the substrate 24 between each of the microstructures 23 so that their signal line 203 pairs conduct. Moreover, the microstructure 23 pairs arranged in the horizontal direction are connected with each other via horizontally extending wiring 32 on the substrate 24 between each of the microstructures 23 so that their scanning line 204 pairs conduct. As a result of these connections, horizontally extending scanning lines and vertically extending signal lines are provided over the entire substrate 24 by means of the scanning line 204 and the signal line 203 in each of the microstructures 23, and the wiring 32 and 31 on the substrate 24. The right end portion of the scanning line 204 of the microstructures 23 positioned furthest to the right edge is connected to the scanning line (X direction) drive portion of an XY driver circuit 22A provided inside the terminal area 22, via the wiring 32.

Furthermore, the microstructure 23 pairs arranged in the vertical direction are connected with each other via vertically extending wiring 33 (shown by the single dot chain line) on the substrate 24 between each of the microstructures 23 so that their common electric supply line 205 pairs conduct. The upper end side of the common electric supply line 205 of the uppermost microstructures 23 is connected to horizontally extending wiring 34 (shown by the single dot chain line) at the upper edge portion of the substrate 24. Furthermore, the end of this wiring 34 is connected to a power supply connection terminal 22B provided inside the terminal portion 22.

Moreover, the first direction conversion wiring 206 and the second direction conversion wiring 207 pair are selectively connected via wiring 35 (shown by the two dot chain line) between each of the microstructures 23 arranged in the horizontal direction. That is, assuming that numbers 1, 2, 3, 4 are given to the microstructures 23 arranged in the vertical direction from the uppermost side, and numbers 1, 2, 3, 4 are given to the microstructures 23 arranged in the horizontal direction from the left side, then with regards to the microstructures 23 where the vertical direction number and the horizontal direction number agree (that is the microstructures positioned on one diagonal line on the substrate 24), the first direction conversion wiring 206 is selected, and with regards to the other microstructure 23 positioned on the terminal portion 22 side, the second direction conversion wiring 207 is selected, and these selected first direction conversion wiring 206 and second direction conversion wiring 207 pairs are connected via wiring 35 (shown as a two dot chain line). Regarding the microstructures 23 positioned on the opposite side to the terminal portion 22 from the microstructures 23 for which the first direction conversion wiring 206 is selected, neither of the first direction conversion wiring 206 and the second direction conversion wiring 207 is selected, and these remain unused.

Furthermore, the right end portion of the wiring selected in the abovementioned procedure of the first direction conversion wiring 206 and the second direction conversion wiring 207 of the microstructures 23 positioned at the rightmost end, is connected via the wiring 35 to the signal line (Y direction) drive portion of the XY driver circuit 22A.

In this manner, regarding each of the display blocks 20 in the present embodiment, by using the first direction conversion wiring 206 and the second direction conversion wiring 207 provided inside the microstructures 23, the drive circuit for the scanning line and the signal line which is normally arranged separated on two sides, is provided on only one side of the display portion 21. Furthermore, by also providing the power supply terminal 22B inside the terminal portion 22, all of the external signals and the power supplies can be supplied from only one side of the display portion 21.

Therefore, compared to the construction where the driver circuit is provided separated on two sides, the display blocks 20 can be brought together compactly. Furthermore, with the present embodiment, the microstructures 23 are used, and the portion where it is necessary to non-contactingly intersect the wiring, is made inside the microstructures 23. Therefore there is also the advantage that the wiring provided on the substrate 24 of the display portion 21 does not need to be multi-layered.

Moreover, the plurality of display blocks 20 constructed in this manner, as shown in FIG. 1A and FIG. 1B, are attached to the transparent substrate 100 so as to be continuous in one direction, and the external signal and power supply are supplied in parallel to each of the display blocks 20. Therefore, a large size display 10 can be easily realized. That is, according to the display 10 of the present embodiment, since the size of the individual display blocks 20 can be small, there is no need for the size of each unit in the production line for the conventional organic EL element display to be large. In other words, the point is only that at the final stage of the manufacturing process, the display blocks 20 can be combined to make up a large size display 10. Therefore, even if many of the parts of the production line are equipment for making a small size display, a large size display 1 can be manufactured.

Furthermore, since the external signal and the power supply are supplied in parallel to each of the display blocks 20, then even if the display 10 is a large size, scanning being not on time does not occur, and the situation where the power supply is insufficient in one part is also avoided.

Moreover, if the construction is as with the present embodiment, where the terminal portion 22 is provided on only one side of the display portion 21, there is also no longer the situation where wide frame portions having no pixels exist between each of the display blocks 20 and divide up the image.

In the case where a large size display 10 is manufactured by the method of the present embodiment, the situation where the image becomes coarse, as with a display which uses light emitting diodes does not arise. That is, fine images can be drawn, and hence this is also suitable for use when viewed comparatively close as with a domestic large size display. For example, also in the case where the image is drawn over an entire large size display, and character information is output to one portion, both of these can be clearly drawn.

In the present embodiment, the description has been for the case where a so-called active drive organic EL element is applied. However this can be similarly applied also with a passive drive. In particular, in the case of a conventional passive drive, since there is an upper limit to the number of scanning lines, it is difficult to realize a large size display 10. However if a construction such as the present embodiment is adopted, then even with a passive drive, a large size display can be easily realized.

Figure 4A:
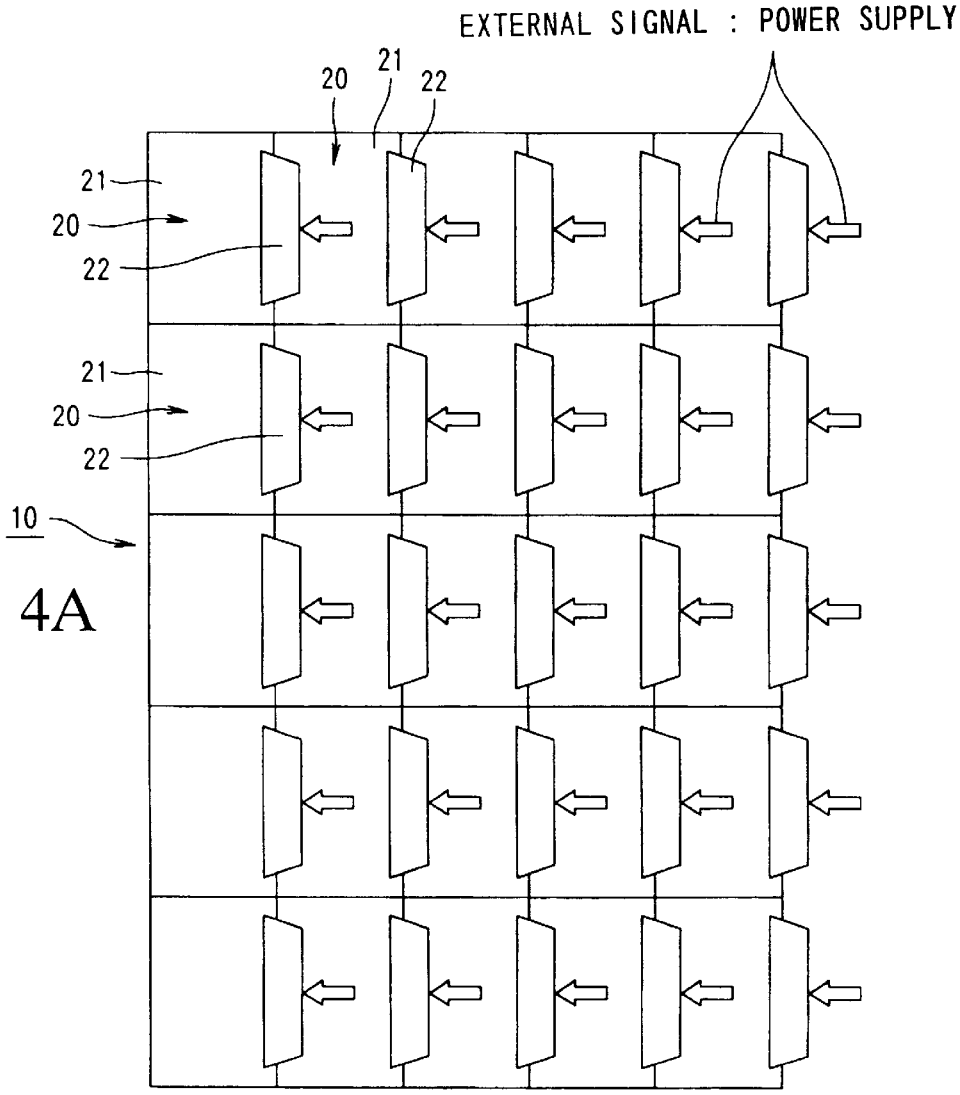
FIG. 4A and FIG. 4B are diagrams illustrating the construction of a second embodiment of the present invention.
Figure 4B:
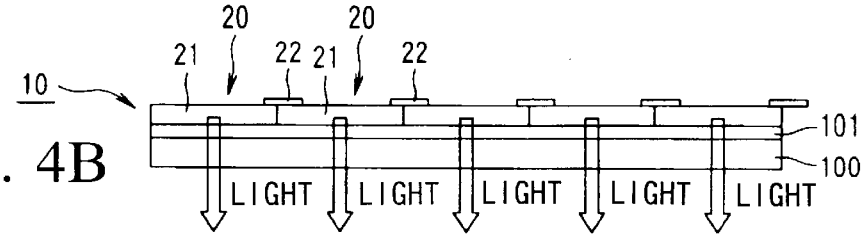

FIG. 4A and FIG. 4B are diagrams showing a second embodiment of the present invention, FIG. 4A being a rear elevation of a display 10 and FIG. 4B being a bottom view of the display 10. Construction the same as for the first embodiment is denoted by the same reference symbols, and repeated description is omitted.

That is, in this embodiment, by making a display block 20 continuous in both the vertical direction and the horizontal direction, an even larger size display 10 can be realized. Moreover, the basic construction is the same as for the first embodiment. However a difference is that terminal portions 22 of the display blocks 20 are offset so as to be positioned on the rear face side (the side opposite to the side to be adhered to transparent substrate 100) rather than the outer edge portion of a display portion 21. By having such a scheme, the entire area of the outer peripheral portion of the display portion 21 is exposed. Therefore the display blocks 20 can be made continuous without any gap, not only in the vertical direction but also in the horizontal direction.

Consequently, according to the construction of this embodiment, an even larger size display 10 can be easily realized. Other operation and effects are the same as for the first embodiment.

Figure 5A:
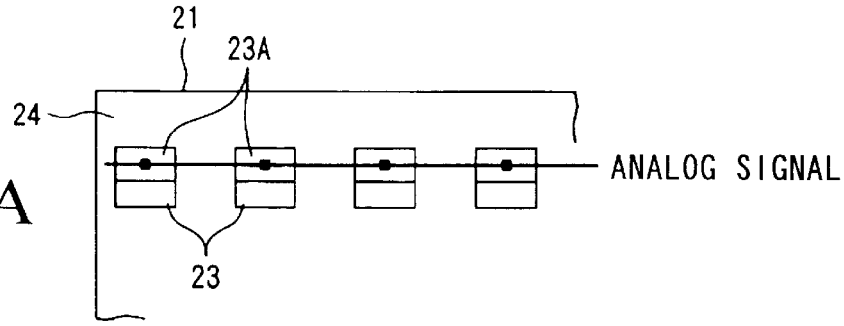
FIG. 5A and FIG. 5B are diagrams illustrating the construction of a third embodiment of the present invention.
Figure 5B:
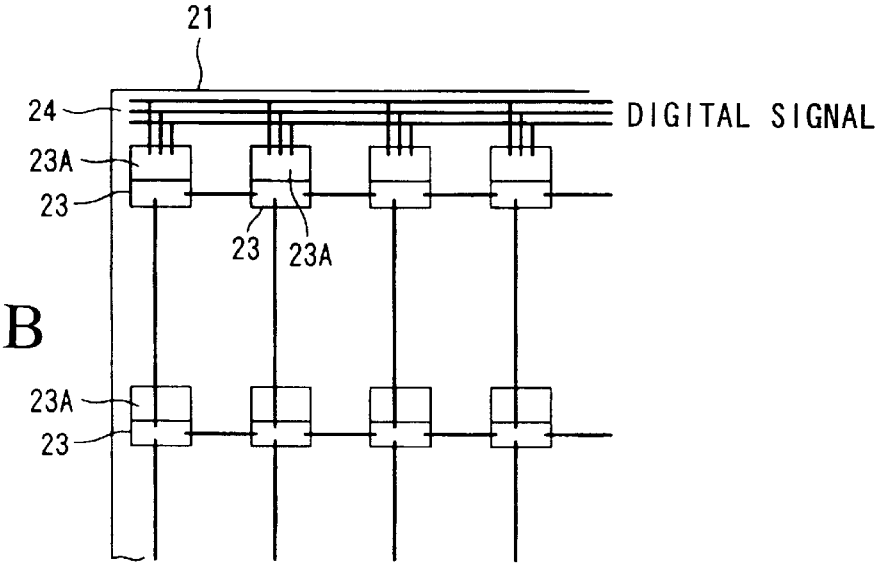

FIG. 5A and FIG. 5B are diagrams illustrating a third embodiment of the present invention, FIG. 5A being for a case where the external signal is an analog signal, and FIG. 5B being for a case where the external signal is a digital signal.

That is, in this embodiment, the XY driver circuit 22A provided inside the terminal portion 22 in the first embodiment and the second embodiment is omitted, and only connection terminals for wiring are provided inside the terminal portion 22, while in the microstructures 23, drive circuits 23A are also made.

According to such a construction, there is no longer the need to make drive circuits in the peripheral portion of the display blocks 20. Therefore only connecting terminals for wiring need be provided inside the terminal portion 22. Consequently this can be made small size. As a result there is greater benefit in adopting the construction where the display blocks 20 such as shown for the first embodiment and the second embodiment are continuous.

In each of the embodiments, the description is given for the case where the display according to the present invention is applied to a display 10 provided with pixels comprising organic EL elements. However the invention is not limited to this, and can also be applied to self luminescent type displays such as liquid crystal devices, electrophoresis display devices, plasma displays and the like. Furthermore, the construction where as shown in FIG. 2, both the signal line and the scanning line are gathered on one side, and the construction as shown in FIG. 5A and FIG. 5B where drive circuits are made inside the microstructures 23, can also be applied for example to sensor arrays, touch pads, fingerprint recognition apparatus, digital cameras and so on.

Moreover, in the above embodiments, the direction of the vertically extending signal line is converted to the horizontal direction. However the invention is not limited to this, and conversely, the direction of the horizontally extending scanning line may be converted to the vertical direction so that both the signal line and the scanning line are gathered on one side.

Electronic Devices

Next is a description of several examples where the organic EL display as one example of the abovementioned electro-optic device, is used in specific electronic devices.

FIRST EXAMPLE

Mobile Type Computer

Figure 6:
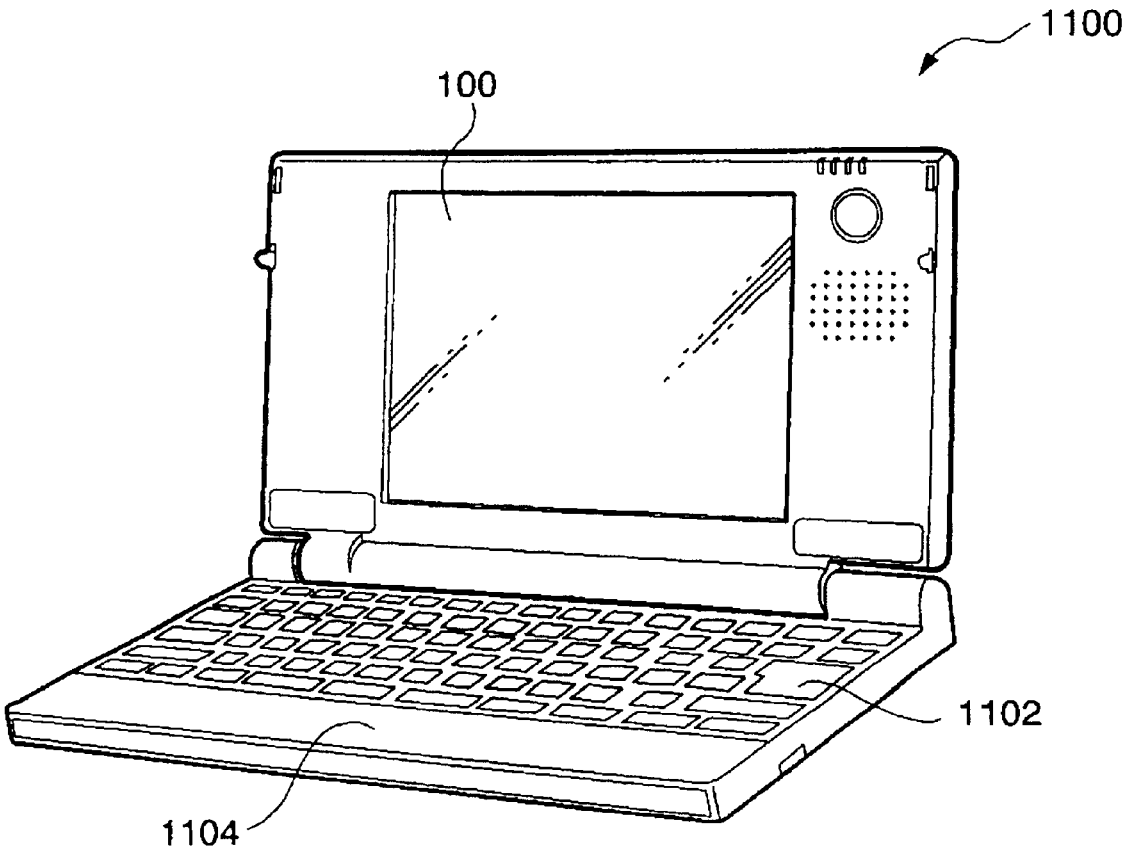
FIG. 6 is a perspective view illustrating a construction of a personal computer being an example of an electronic device of the present invention.

At first is a description of an example for where an organic EL display according to the embodiments is applied to a mobile type personal computer. FIG. 6 is a perspective view illustrating the construction of this personal computer. In the figure, a personal computer 1100 comprises a main frame 1104 incorporating a key board 1102, and a display unit 1106. The display unit 1106 has an organic EL display panel 100.

SECOND EXAMPLE

Portable Telephone

Figure 7:
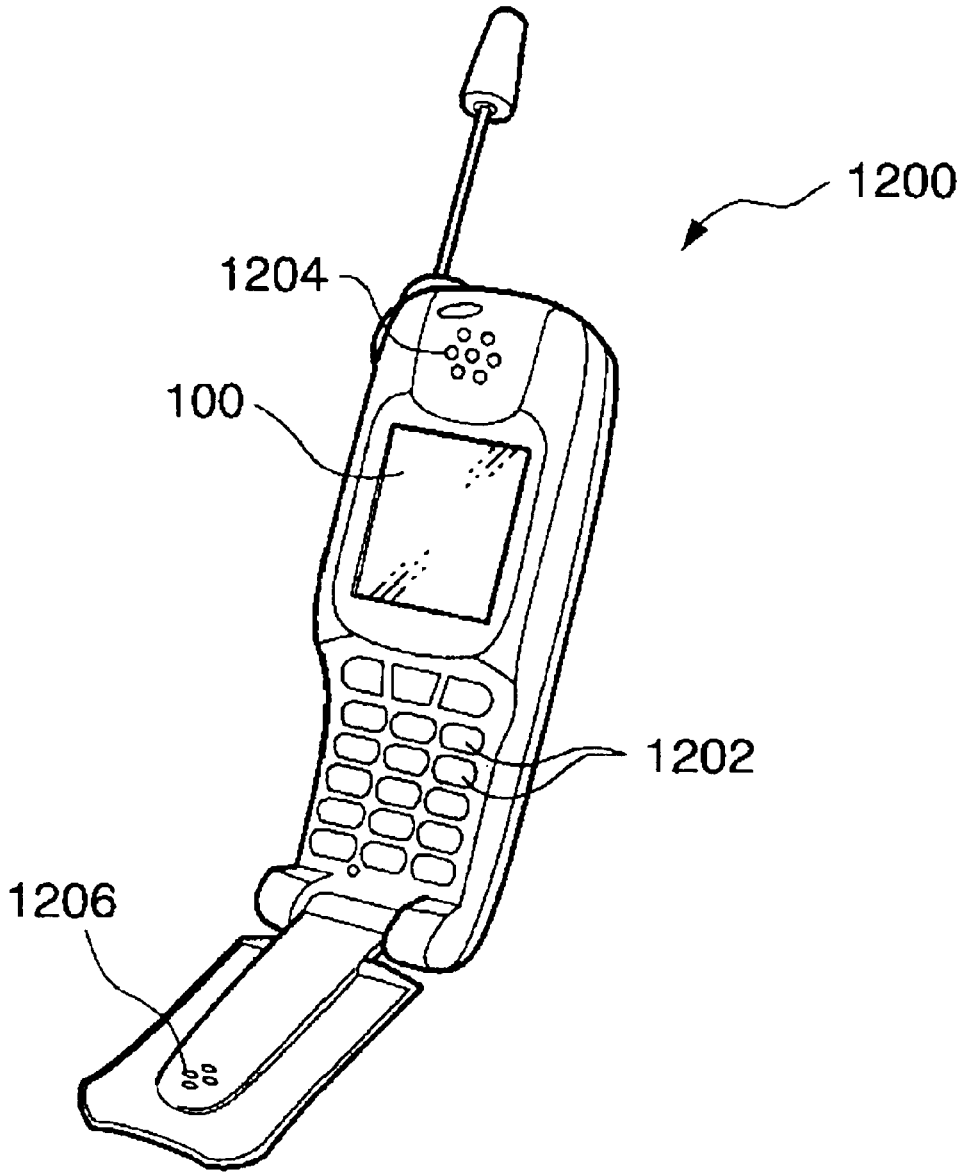
FIG. 7 is a perspective view illustrating a construction of a portable telephone being an example of an electronic device.

Next is a description of an example for where an organic EL display is applied to a display portion of a mobile telephone. FIG. 7 is a perspective view illustrating the construction of this mobile telephone. In the figure, a mobile telephone 1200 incorporates a plurality of operating buttons 1202 as well as, an earpiece 1204, a mouth piece 1206 and the abovementioned organic EL display panel 100.

THIRD EXAMPLE

Digital Still Camera

Figure 8:
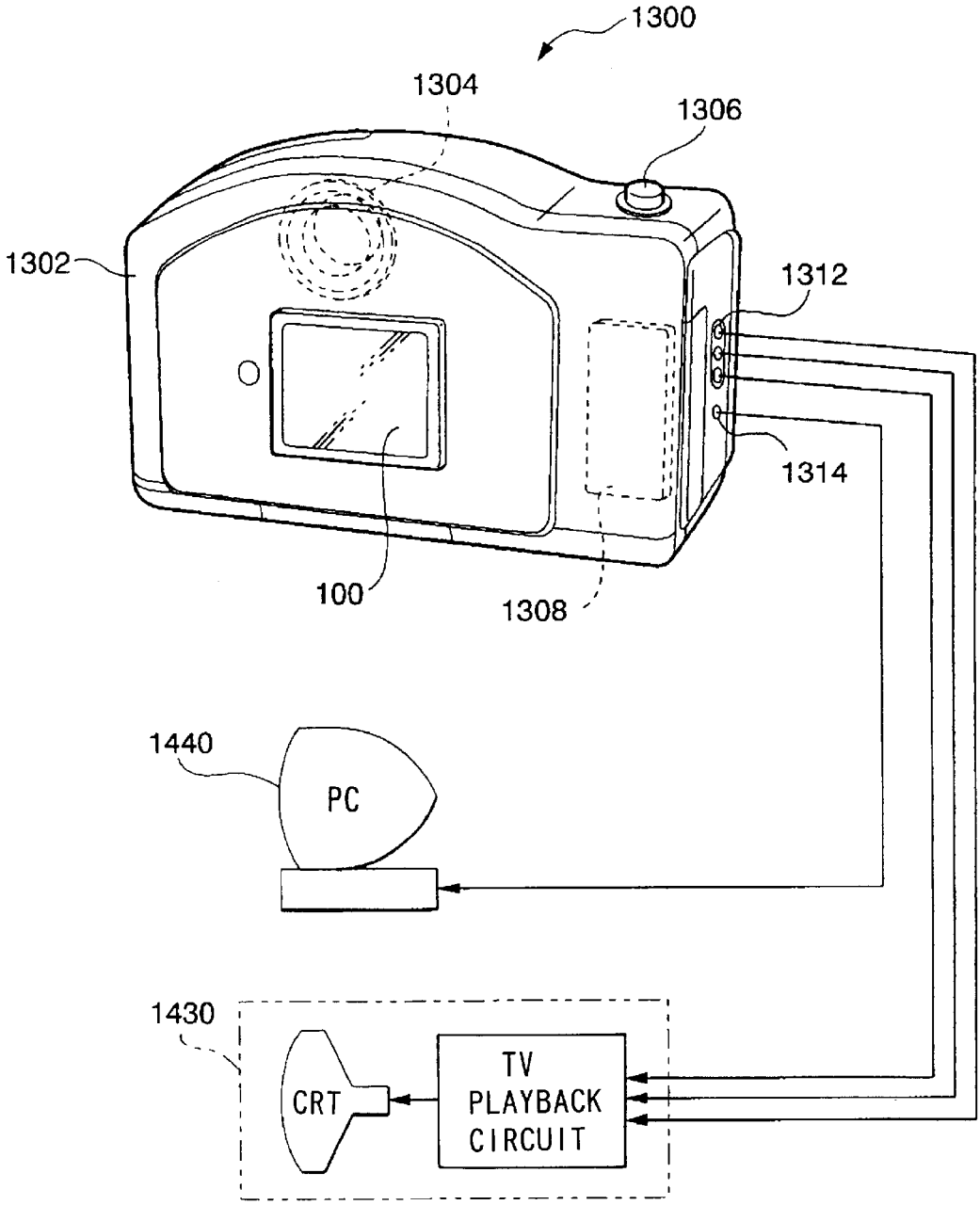
FIG. 8 is a perspective view illustrating a construction of a rear face side of a digital still camera being an example of an electronic device.

Next is a description of a digital still camera which uses an organic EL display in a finder. FIG. 8 is perspective view illustrating the construction of this digital still camera, with connections for external equipment also shown simplified.

In contrast to a normal camera where the film is exposed by an optical image of a photographic subject, with the digital still camera 1300, the optical image of the photographic subject is photoelectrically converted by an imaging element such as a CCD (charged coupled device) to thereby produce an image signal. Here, the construction is such that the abovementioned organic EL display panel 100 is provided on a back face of a case 1302 of the digital still camera 1300, and display is performed based on the image signal from the CCD. Therefore the organic EL display panel 100 functions as a finder for displaying the photographic subject. Furthermore, on the viewing side (the rear face side in the figure) of the case 1302 there is provided a light receiving unit 1304 which includes an optical lens and a CCD or the like.

Here, when the photographer has confirmed the subject image displayed on the organic EL display panel 100 and pushes a shutter button 1306, the image signal from the CCD at that time is sent to a memory of a circuit substrate 1308 and stored therein. Furthermore, in this digital still camera

1300, on the side face of the case 1302 there is provided a video signal output terminal 1312 and an input-output terminal 1314 for data communication. Moreover, as shown in the figure, as required, a television monitor 1430 is connected to the former video signal output terminal 1312, or a personal computer 1430 is connected to the later data communication input-output terminal 1314. Furthermore, the construction is such that by a predetermined operation, the imaging signal stored in the memory of the circuit substrate 1308 is output to the television monitor 1430 or the personal computer 1440.

For the electronic device, in addition to the personal computer of FIG. 6, the mobile telephone of FIG. 7, or the digital still camera of FIG. 8, there can be given devices such as a liquid crystal television, a view finder type or direct view monitor type video recorder, a car navigation unit, a pager, an electronic notebook, an electronic calculator, a word processor, a work station, a video phone, a POS terminal, a device furnished with a touch panel and so on. Moreover, needless to say for the display portion of these various electronic devices, the abovementioned display device can be applied.

What is claimed is:

1. A display having a plurality of display blocks, each of the display blocks comprising:

a plurality of pixels;

a plurality of horizontally extending wiring lines;

a plurality of vertically extending wiring lines; and a terminal portion that conducts the plurality of horizontally extending wiring lines and the plurality of vertically extending wiring lines, and into which signals can be input for controlling optical characteristics of each of the pixels, the plurality of display blocks being linked together to be continuous in one direction, the signals being input parallel to each of the plurality of the display blocks through each terminal portion, and each terminal portion being provided at only one side of each of the plurality of the display blocks.

2. A display having a plurality of display blocks, each of the display blocks comprising:

a plurality of pixels;

a plurality of horizontally extending wiring lines;

a plurality of vertically extending wiring lines; and a terminal portion that conducts the plurality of horizontally extending wiring lines and the plurality of vertically extending wiring lines, and into which signals can be input for controlling light emitting characteristics of each of the pixels, the plurality of display blocks being linked together to be continuous in one direction, the signals being input parallel to each of the plurality of the display blocks through each terminal portion, and each terminal portion being provided at only one side of each of the plurality of the display blocks.

3. The display according to claim 2, a power supply being supplied in parallel to each of the display blocks via the terminal portion.

4. The display according to claim 2, the terminal portion being provided so as to be positioned on a rear side of each of the display blocks, which is the side opposite to a side from which light is emitted, rather than a periphery portion of each of the display blocks.

5. The display according to claim 2, the display blocks having a construction in which a plurality of microstructures made with electronic circuit elements are disposed on substrates of the display blocks.

6. The display according to claim 5, drive circuit for each of the pixels being made in the microstructure.

7. A display having a plurality of display blocks, each of the display blocks comprising:

a plurality of pixels containing organic EL elements;

a plurality of horizontally extending wiring lines;

a plurality of vertically extending wiring lines;

a terminal portion that conducts the plurality of horizontally extending wiring lines and the plurality of vertically extending wiring lines, and into which signals can be input for controlling optical characteristics of each of the pixels;

the plurality of display blocks being linked together to be continuous in one direction, the signals being input parallel to each of the plurality of the display blocks through each terminal portion, and each terminal portion being provided at only one side of each of the plurality of the display blocks.

8. The display according to claim 7, a power supply being supplied in parallel to each of the display blocks via the terminal portion.

9. The display according to claim 7, the terminal portion being provided so as to be positioned on a rear side of each of the display blocks, which is the side opposite to a side from which light is emitted, rather than a periphery portion of each of the display blocks.

10. The electronic device according to claim 9, a plurality of microstructures with drive circuits being arranged on substrates of the display blocks, and the microstructures being connected by wiring, and a signal can be supplied from the outside to a terminal portion of the wiring.

11. The display according to claim 7, the display blocks having a construction in which a plurality of microstructures made with electronic circuit elements are disposed on substrates of the display blocks.

12. The display according to claim 11, a drive circuit for each of the pixels being made in the microstructure.

13. An electronic device comprising:

a substrate;

a plurality of horizontally extending wiring lines;

a plurality of vertically extending wiring lines;

a plurality of microstructures being arranged on the substrate and provided at intersections of the plurality of horizontally extending wiring lines and the plurality of vertically extending wiring lines, the intersections in the microstructures having a portion where the horizontally extending wiring lines and vertically extending wiring lines intersect without contacting each other;

a terminal portion that conducts the plurality of horizontally extending wiring lines and the plurality of vertically extending wiring lines;

a first direction conversion wiring line that conducts with one of the horizontally extending wiring lines or the vertically extending wiring lines, and that extends from the microstructures in the same direction as the other one of the horizontally extending wiring lines or the vertically extending wiring lines; and a second direction conversion wiring line that does not conduct with any other wiring, and extends from the microstructures in the same direction as the first direction conversion wiring line, pairs of the horizontally extending wiring lines of the microstructures adjacent in the horizontal direction being connected, pairs of the vertically extending wiring lines of the microstructures adjacent in the vertical direction being connected, and the first direction conversion wiring lines and the second direction conversion wiring lines being selectively connected, so that the terminal portion is gathered at one side of the substrate.

14. A display comprising:

a substrate;

horizontally extending wiring lines;

vertically extending wiring lines;

a plurality of microstructures being provided on the substrate at positions corresponding to intersections of the horizontally extending wiring lines and the vertically extending wiring lines;

a terminal portion being provided at one side of the substrate; and connecting wiring lines being connected with either the horizontally extending wiring lines or the vertically extending wiring lines, the connecting lines being provided between the microstructures and extending in the same direction as the other extending wiring lines that are not connected with the connecting wiring lines, and the terminal portion conducting the connecting wiring lines and the other extending wiring lines that are not connected with the connecting wiring lines, so that the terminal portion is provided at only one side of the substrate.

* * * * *